US009259125B2

(12) United States Patent
Watkins

(10) Patent No.: US 9,259,125 B2
(45) Date of Patent: Feb. 16, 2016

(54) EXTENDED USE ELEVATED URINAL TRAY

(71) Applicant: Timothy Joseph Watkins, Laveen, AZ (US)

(72) Inventor: Timothy Joseph Watkins, Laveen, AZ (US)

( * ) Notice: Subject to any disclaimer, the term of this patent is extended or adjusted under 35 U.S.C. 154(b) by 0 days.

(21) Appl. No.: 13/987,154

(22) Filed: Jul. 5, 2013

(65) Prior Publication Data

US 2015/0013780 A1 Jan. 15, 2015

(51) Int. Cl.
*E03D 11/00* (2006.01)
*A47K 17/00* (2006.01)

(52) U.S. Cl.
CPC ..... *A47K 17/00* (2013.01); *Y10T 137/5762* (2015.04)

(58) Field of Classification Search
CPC ..... A47G 27/0225
USPC ..... 4/251.1–251.2
See application file for complete search history.

(56) References Cited

U.S. PATENT DOCUMENTS

| | | | | |
|---|---|---|---|---|
| 2,897,108 | A * | 7/1959 | Harwood | 428/152 |
| 4,125,656 | A * | 11/1978 | Creamer | 4/251.1 |
| 4,285,075 | A * | 8/1981 | Nelson | 4/251.1 |
| 4,903,723 | A * | 2/1990 | Sublett | 137/312 |
| 5,452,739 | A * | 9/1995 | Mustee et al. | 137/312 |
| 5,775,869 | A * | 7/1998 | Bishop | 414/608 |
| 5,883,300 | A * | 3/1999 | Johnson | 73/40 |
| 6,265,084 | B1 * | 7/2001 | Stickler | 428/542.8 |
| 6,279,781 | B1 * | 8/2001 | Konar | 222/108 |
| 6,446,275 | B1 * | 9/2002 | Wright et al. | 4/251.1 |
| 7,216,778 | B2 * | 5/2007 | Kaeb | 222/108 |
| 7,363,936 | B1 * | 4/2008 | Simoneaux et al. | 137/312 |
| 7,921,479 | B2 * | 4/2011 | Hunter | 4/309 |
| D639,410 | S * | 6/2011 | Ramirez | D23/310 |
| 8,236,402 | B1 * | 8/2012 | Stickler et al. | 428/80 |
| 8,291,526 | B2 * | 10/2012 | Parvizian | 4/254 |
| 8,578,975 | B2 * | 11/2013 | Ernst | 141/86 |
| 8,590,559 | B1 * | 11/2013 | Gutierrez | 137/312 |
| 8,691,024 | B2 * | 4/2014 | Barniak, Jr. | 134/42 |
| 8,856,977 | B2 * | 10/2014 | Ramirez | 4/309 |
| 2009/0003933 | A1 * | 1/2009 | Anderson et al. | 405/119 |
| 2009/0158512 | A1 * | 6/2009 | Stickler et al. | 4/251.1 |
| 2010/0018980 | A1 * | 1/2010 | Oakner et al. | 220/571 |
| 2011/0180153 | A1 * | 7/2011 | Carter et al. | 137/312 |
| 2011/0315237 | A1 * | 12/2011 | Jenkins | 137/312 |
| 2013/0098470 | A1 * | 4/2013 | Sass | 137/15.01 |
| 2013/0305443 | A1 * | 11/2013 | Baranj et al. | 4/251.1 |
| 2014/0352802 | A1 * | 12/2014 | Lardelli et al. | 137/312 |

* cited by examiner

*Primary Examiner* — Lori Baker

(57) ABSTRACT

A extended use elevated urinal tray for high volume usage mounted wall urinals (32) to prevent urine splatters (34) from accumulating on the floor or a mat underneath the urinals extreme edge (30) comprising a base frame portion (18) adapted for placement on the floor underneath the urinal (32) and allows variability for urinal users of different foot sizes placement and an elevated sloped tray portion (10) disposed on the base portion that does not come in contact with the urinal users shin (38) or ankle (36) area and covers the open space (40) between the users ankles and high shin area that urine splatters transit to accumulate on the floor; equipped with a detachable member (26) near the downward end of the sloped tray capable of receiving, and absorbing urine deposits until such time the absorbent material (28) is emptied, replenished and replaced for continued use.

6 Claims, 5 Drawing Sheets

EXTENDED USE ELEVATED URINAL TRAY

BACKGROUND FIELD OF INVENTION

This invention relates to the placement of an elevated urinal tray for preventing urine from accumulating on a restroom floor or on a mat underneath the urinal. More specifically, the current inventions intended purpose is to is to prevent a urinal user at high volume public type restrooms, such as restrooms at large sporting events, restaurants and concerts from having to step on a urine saturated mat or urine puddled on the floor.

DESCRIPTION OF PRIOR ART

The use of urinal mats and methods of controlling urine spillage underneath urinals is known prior art. More specifically, heretofore methods devised and utilized for the purpose of preventing urine from being deposited on the floor directly below the urinal bowl are known to consist basically of familiar, expected and obvious structural configurations, notwithstanding the myriad of designs encompassed by the crowded prior art which have been developed for the fulfillment of countless objectives and requirements. By way of example, U.S. patent number to Stickler, et al., and numerous other variations of similar patents disclose apparatus that are placed directly on the floor below the urinal and allow urine deposits to accumulate on the floor or on a floor mat. None of the prior are provides an apparatus designed specifically to cover the open area between the urinal users legs and capture urine deposits directly underneath of the urinal and off the floor to prevent urine deposits from ever accumulating on the or on a urinal mat that urinal users step on contaminating their shoes and other areas outside of the public restroom.

In retrospect, the extended use elevated urinal tray, according to the present invention substantially decreases the conventional concepts, and in doing so provides an apparatus primarily developed for the purpose of capturing urine spillage from high volume public wall mounted urinals for extended periods of time just below the urinals extreme edge, high enough off the floor to allow unobstructed movement of the urinal users feet and not contact the users legs. The urine spillage is absorbed and stored until the absorbent material is removed and replenished.

The present invention achieves its intended objects and advantages through a new and useful unobvious combination of methods, steps and components with a minimum number of functional parts and at a reasonable cost to manufacture with readily available materials.

OBJECTS AND ADVANTAGES

Accordingly, besides the objects and advantages of this inventions method to capture urine spillage, several additional objects and advantages of this current invention are to:

(a) provide an extended use elevated urinal tray that can universally be applied to a wide variety of public high volume wall mounted type urinals, (b) provide an apparatus adapted for easy placement and prolonged use, (c) provide an apparatus that is inexpensive to manufacture by injection molding with readily available materials, (d) provides an apparatus that requires low maintenance and can be re-sanitized for continued use, (e) provides an apparatus adapted to have absorbent scented material replaced for continued use.

The foregoing has outlined some of the pertinent objects of the invention. These objects should be construed to be merely illustrative of some of the more prominent features and applications of the present invention. Many other beneficial results can be attained by applying the disclosed in a different manner or by modifying the invention within the scope the disclosure. Therefore, it can be appreciated that there exist a continuing need for an extended use elevated urinal tray, in this; present invention substantially fulfils this need. The prior are and commercial techniques do not suggest the inventive combination of component elements and features configured as disclosed and claimed herein. Still further objects and advantages will become apparent from a consideration of ensuing description and drawings.

DRAWING FIGURES

In the drawings, closely related figures have the same number but different alphabetical suffixes.

EXTENDED USE ELEVATED URINAL TRAY

Reference Numerals in Drawing FIGS

10 SLOPED TRAY PORTION
12 INSERT PIN OPENING
14A LEFT INSERT PIN OPENING
14B RIGHT INSERT PIN
16A LEFT BASE FRAME SIDE
16B RIGHT BASE FRAME SIDE
18 BASE FRAME ASSEMBLY
20 SLOPED TRAY PORTION PIN INSERT BRACE
22A RIGHT PIN INSERT OPENING
22B INSERT BRACE PIN INSERT OPENING
22C LEFT PIN INSERT OPENING
24 DUMP TRAY INSERT OPENING
26 DUMP TRAY
28 ABSORBENT COMPOSITION
30 EXTREME URINAL EDGE
32 URINAL
34 URINE SPLATTER COVERAGE AREA
36 ANKLE
38 SHIN
40 OPEN AREA
42 WALL

SUMMARY

In accordance with the present invention, the extended use elevated urinal tray comprises a sloped tray portion disposed on a rigid horizontal "A" shaped base frame assembly with the wide end of the "A" shaped frame positioned on the floor nearest the wall; and the narrowest end underneath the extreme edge of the urinal bowl. The narrowest end is adapted to allow the urinal users feet to have variable movement underneath of the sloped tray portion and urinal. The sloped tray portion extends gradually upward from the floor towards the direction of the urinal user in a manner to not contact the urinal users shin area and ankles. The sloped tray portion covers and collects urine splatters in the area directly under the extreme end of the urinal where urine splatters puddle on the floor or saturate a urinal type mat. The current invention allows the collected urine to flow into a dump tray where it is absorbed by a suitable absorbent material, until such time the absorbent material is disposed of and replenished for continued use.

These together with other objects of the invention, along with various features of novelty which characterize the invention, are pointed out with particularity in the claims annexed to and forming part of this disclosure. For a better understanding of the invention, it's operating advantages and specific objects attained by its uses, reference should be made to the accompanying drawings and descriptive matter in which there are illustrated embodiments of the invention.

DESCRIPTION

FIGS. 1 TO 5

Figure 1:
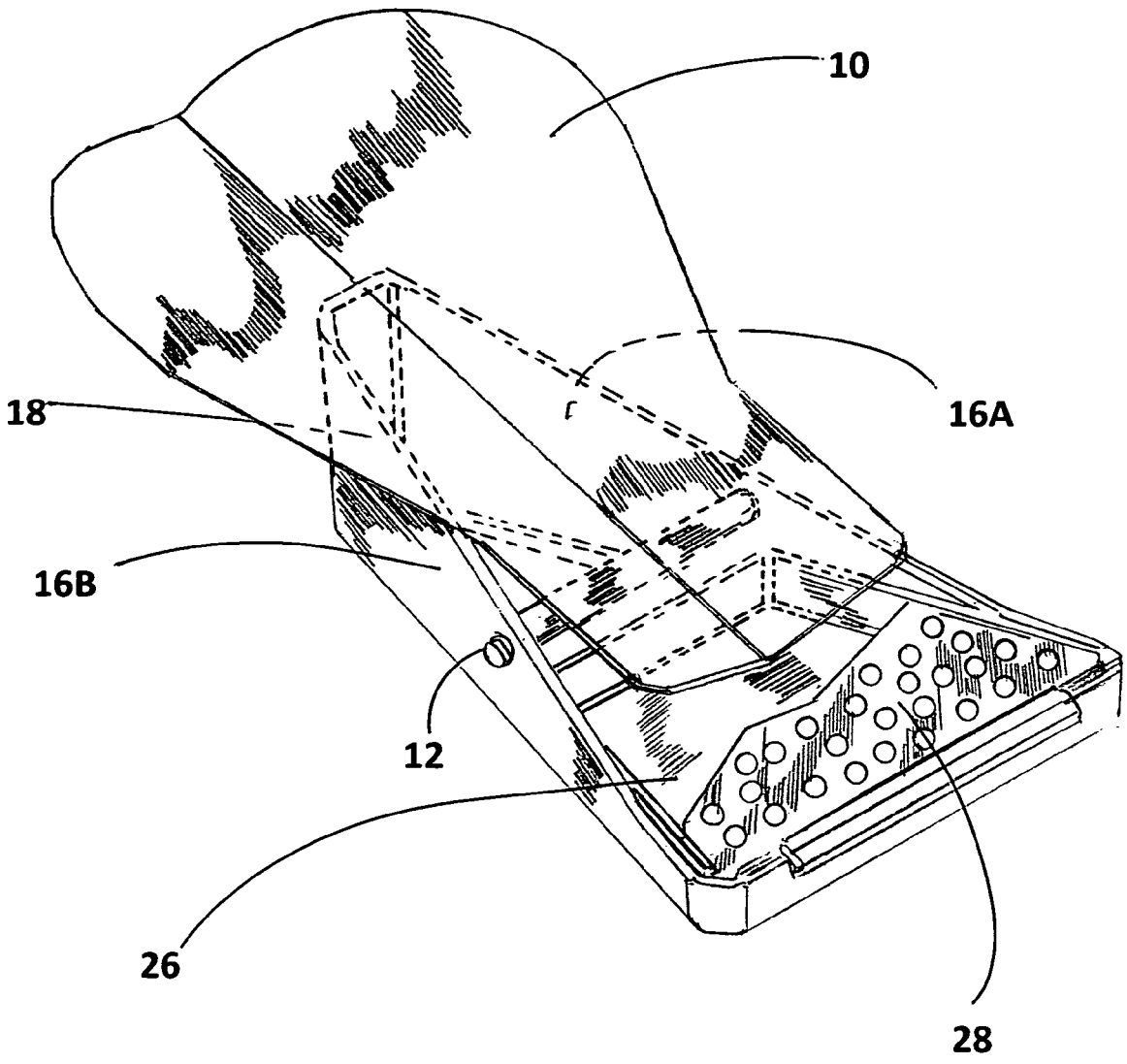
FIG. 1 illustrates a prospective view of the current invention.
Figure 2:
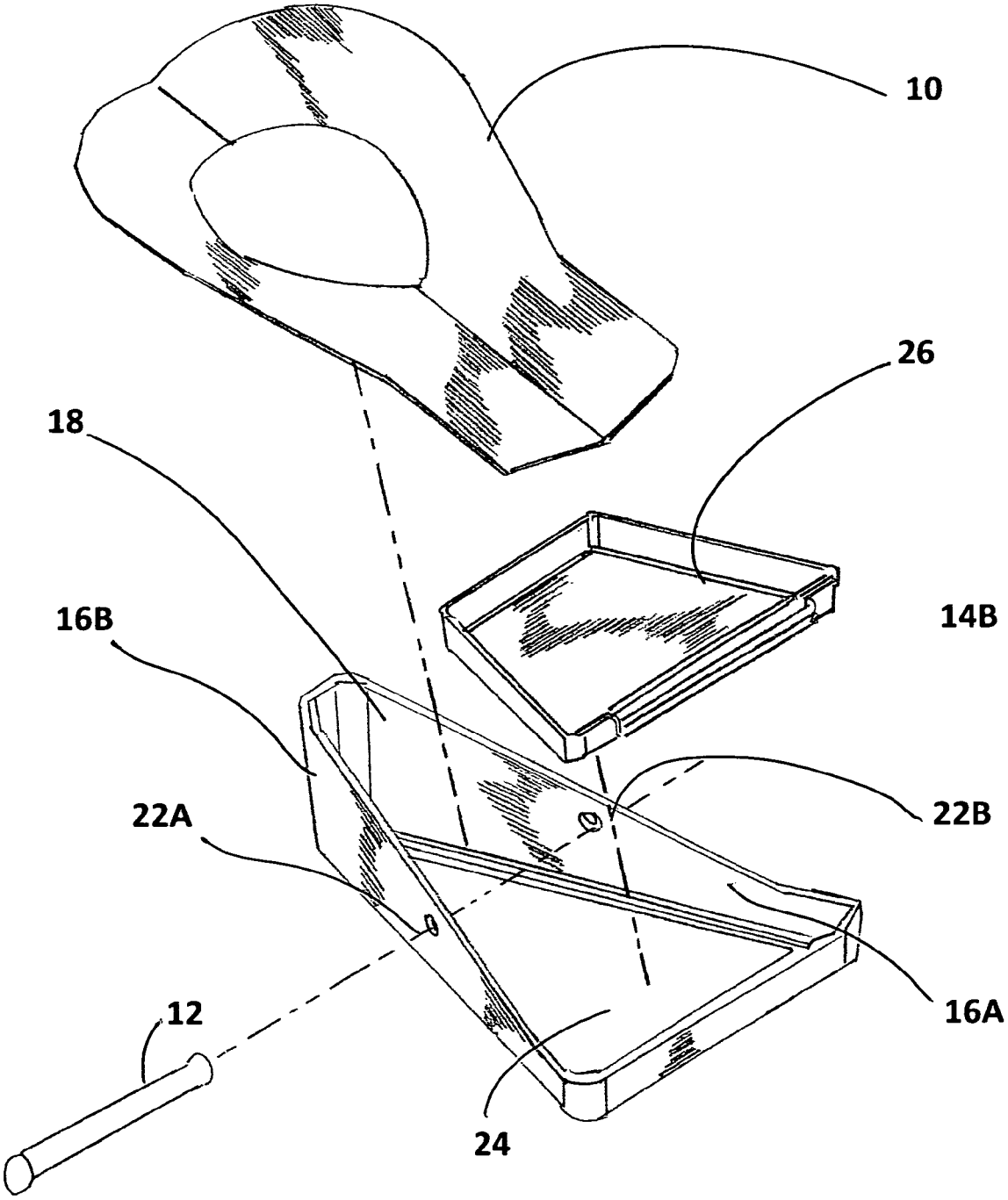
FIG. 2 illustrates the manner of construction.
Figure 3:
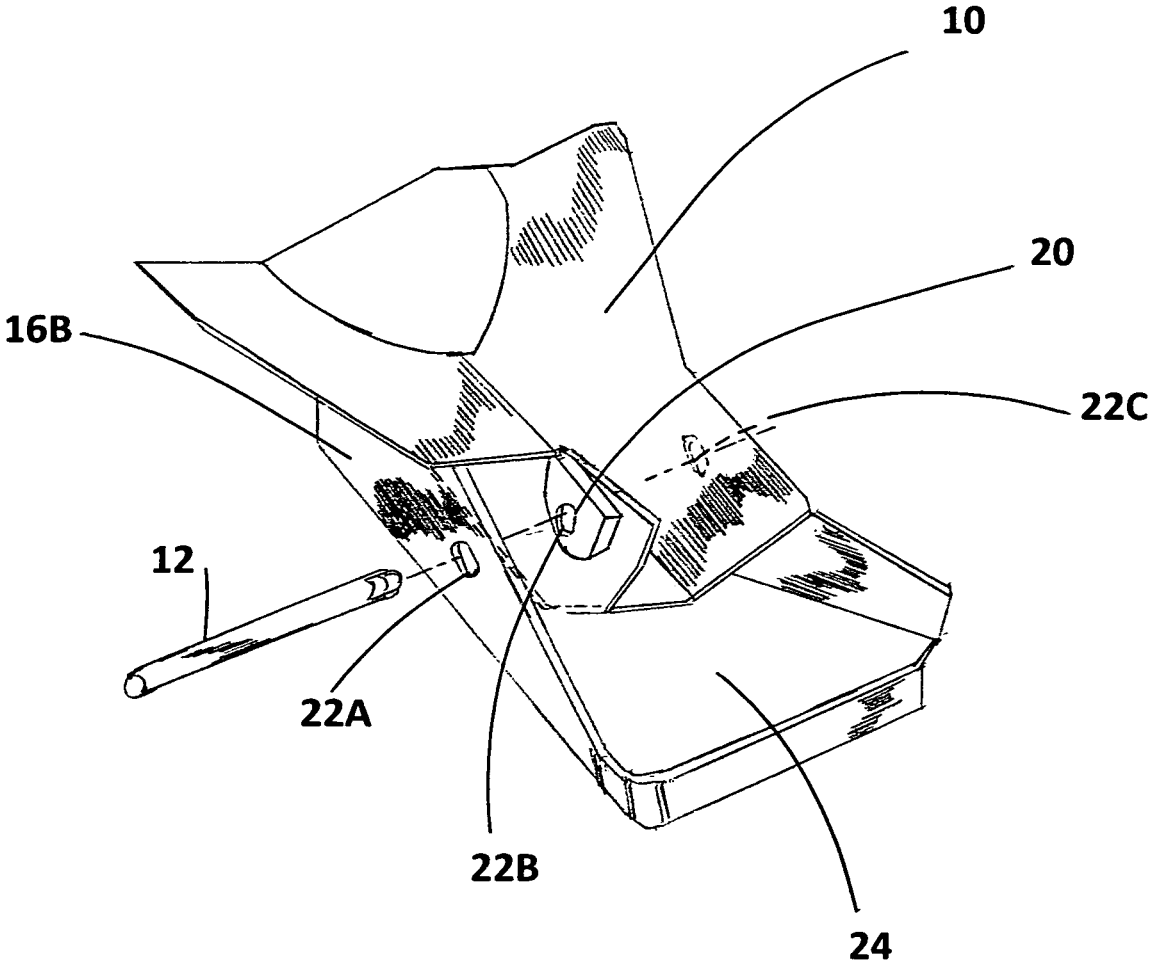
FIG. 3 illustrates a sectional view of the base frame portion and sloped tray connection.

A typical embodiment of the extended use elevated urinal tray is illustrated in FIG. 1. The entire invention with the exception of the absorbent material is constructed by injection molding from a suitable rigid composition with plastic as the preferred material. A sloped tray portion is positioned at a predetermined height and gradually slopes downward away from the urinal user. The sloped tray portion is attached to a base frame assembly (18) that comprises a right base frame side (16B), and left base frame side (16A) that resembles a horizontal letter "A". Disposed under the extreme end of the sloped tray portion is a removable dump tray (26), adapted to receive scented absorbent material (28) and be inserted into a dump tray insert opening (24) between the right and left base frame sides. A sloped tray portion insert brace (20), illustrated in FIG. 3, located on the bottom side of the sloped tray portion and is adapted to have an insert pin (12) inserted through insert pin openings (22A,22B,22C) to properly orientate the current invention.

Figure 4:
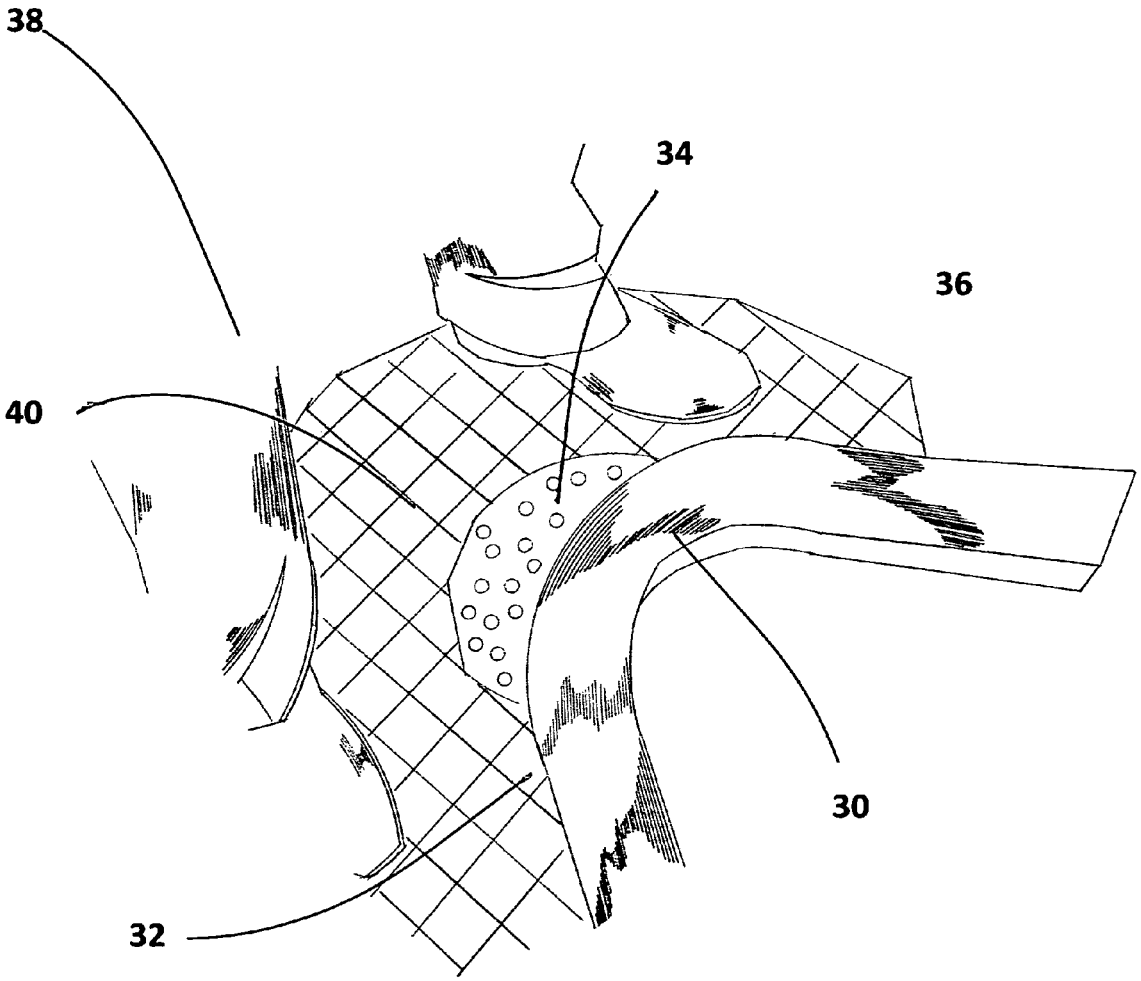
FIG. 4 illustrates a perspective view of the sloped tray coverage area.
Figure 5:
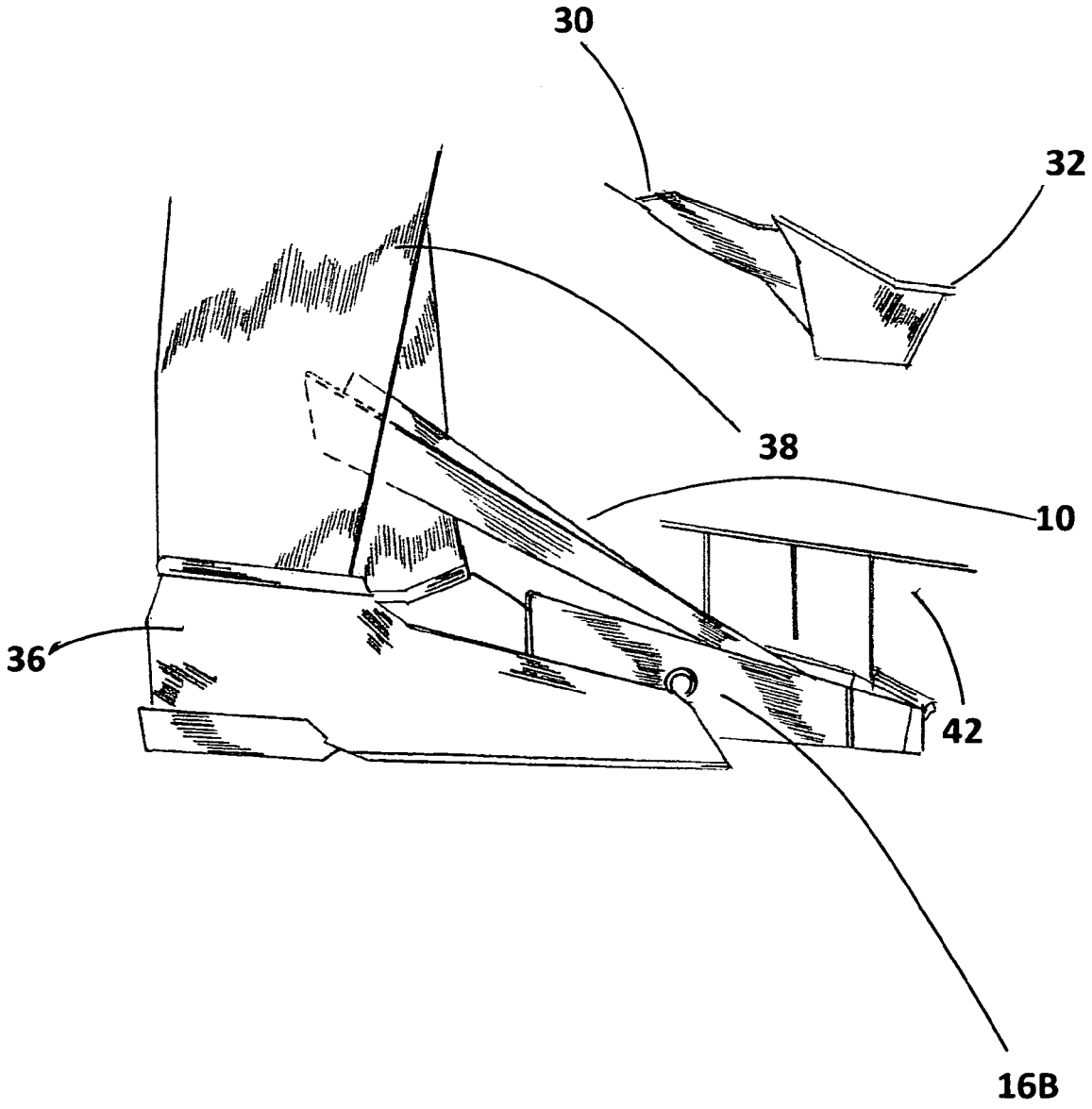
FIG. 5 illustrates a prospective view of the urinal user's foot placement.

The current invention can be manufactured as one piece, however for shipping and storage purposes; separating the sloped tray portion from the base frame assembly allows multiple extended use elevated urinal trays to be shipped in one box. Illustrated in FIG. 4 is the open area (40) area underneath of the urinal at the extreme edge of the urinal bowl (30). The current invention is adapted to cover the target area (34) where most of the urine collects on the floor. FIG. 5 illustrates the relative position of the current invention and the urinal user. The base frame assembly (18) is adapted to be placed in close proximity to or in contact with the urinal wall (42). Because the base frame assemblies narrowest end is nearest the urinal user and the sloped tray is elevated with the highest end nearest the user; there is space for foot maneuverability underneath the tray if needed to accommodate users of differing sizes. The sloped tray portion is adapted to be above the ankle area (36), approximately in the high chin area (38), underneath the extreme edge of the urinal (30).

From the description above, a number of advantages of the extended use elevated urinal tray become evident:

Extended Use Elevated Urinal Tray a) the extended use elevated urinal tray can be easily and quickly applied to a wide variety of high and low wall mounted type urinals to prevent urine from ever making contact with the floor and thereby preventing users from having to step in urine saturated floors or mats, b) the current invention can be easily mass applied at high volume public restrooms such as major sporting event stadiums, airports, schools, and not be serviced the entire event, c) the current invention can easily have the sloped tray cleaned with a disinfectant and the tray refilled with absorbent material in a short time frame.

OPERATION

FIGS. 1,2,3,4,5

The manner of using the extended use elevated urinal tray is to attach the sloped tray portion (10) to the base frame assemblies right (16B) and left (16A) portion by aligning the opening on the sloped tray insert brace (22B) and base frame openings (22A,22B). Insert pin (12) is then inserted through the openings. Position the current invention with the base frame assembly dump tray (26) end flush or in close proximity to the urinal wall (40). The sloped tray portion should be centered on the urinals extreme edge (30). The urinal user should use the urinal in the same manner. The sloped tray portion should cover the open area (40) where most urine splatters occur, below the extreme edge of the urinal bowl (34) without obstructing the urinal users access. When the absorbent material (28) is oversaturated with urine, simply spray a suitable disinfectant onto the sloped tray portion and let it drain into the dump tray (26) before removing the dump tray and dispose of the saturated absorbent material. Refill the dump tray with fresh absorbent material and reinsert the dump tray into the dump tray insert opening (24).

Summary Ramifications and Scope

Accordingly, the reader will see that the extended use elevated urinal tray can be repeatedly used inexpensively and conveniently to capture urine deposits before contacting the floor or a urinal type mat. Allows for easy waste disposal of contaminated absorbent material, thereby eliminating the need to frequently replace and dispose of contaminated urinal mats and prevents the urinal user from stepping in urine saturated on the floor or in mats and then contaminate areas outside frequently used high volume public restrooms.

As to the manner of usage and operation of the present invention, the same should be apparent from the description, accordingly, no further discussion relating to the manner of usage and operations will be provided. With respect to the above description, then it is to be realized that optimum dimensional relationships for parts of the invention, to include variations in size, materials shape, form, fit, function and manner of operation, assembly and usage, are deemed readily apparent and obvious to one skilled in the art, and all equivalents relationships to those illustrated in the drawings and described in specifications are indeed to be encompassed by the present invention. Therefore, the foregoing is considered as illustrative only of the principals of the invention further, since numerous modifications will readily occur by those skilled in the art, it is not desired to limit the invention to exact connection and orientation shown and described, and accordingly, all suitable modification and equivalents may be resorted to, falling within the scope of the invention. In as much as the present invention disclosure includes all contained in the invention, appended claims as well as that of the foregoing description, and although this invention has been described in its preferred forms with a certain degree of particularity, it is understood that the present disclosure of the preferred form has been made only by way of example and numerous changes in details of the construction and combination and arrangements of parts may be resorted to without departing from the spirit and scope of the invention. Thus the scope of the invention should be determined by appended claims and their equivalents, not the examples given.

What I claimed is:

1. An extended use elevated urinal tray for use underneath wall-urinals with the purpose of capturing urine drippings above a floor surface and below a extreme edge of said wall-urinal to prevent a urinal user from stepping on a urine saturated floor or a urine saturated floor mat and contaminating additional floor surfaces not in close proximity to said wall-urinal, comprising:

(a) rigid base frame portion adapted for placement on the floor underneath the wall mounted urinal with a predetermined narrow horizontal width on one extreme end and a opposite extreme end of predetermined wider horizontal width facing the direction of the urinal wall, and said narrow horizontal width end facing the direction of the urinal user, and (b) a rigid fluid resistant elongate portion of predetermined width and length with one extreme end of the rigid fluid resistant elongate portion of higher elevation than opposite extreme end and adapted to receive liquids and cause liquids to flow in a downward direction, and (c) a rigid removable containment portion disposed in a manner to receive liquids from said rigid fluid resistant elongate portion lower elevation extreme end.

2. The apparatus as set forth in claim 1 wherein said rigid fluid resistant elongate portion is disposed at predetermined elevation with said higher elevation extreme end nearest said urinal user and gradually sloping downward toward said rigid removable containment portion allowing variable movement underneath said urinal and said rigid fluid resistant elongate portion extreme higher elevation end, and (a) said rigid fluid resistant elongate portion is adapted to cover approximate 10 inch diameter circumference from said extreme higher elevation end of said rigid fluid resistant elongate portion, and (b) said rigid fluid resistant elongate portion extreme higher elevation end away from said urinal wall is approximately 7 inches vertical height from floor surface, said lower elevation extreme end is approximately 1 inch vertical height above surface of said removable containment portion.

3. The apparatus as set forth in claim 1 wherein said extreme lower elevation end of said rigid fluid resistant elongate portion is disposed in manner to deposit liquids in the approximate center of said rigid removable containment portion.

4. The rigid removable containment portion as set forth in claim 2 wherein said rigid removable containment portion is adapted to receive a suitable scented absorbent material, dispose of contaminated said suitable absorbent material, be sanitized and replenished with additional said scented suitable absorbent material for continued use.

5. The apparatus as set forth in claim 1 wherein any method may be used to construct the apparatus, including but not limited to hollow or solid fill, casting, injection molding, vacuum-forming, hydro-forming, welding, gluing, bonding, die-cut, and/or extrusion.

6. The apparatus as set forth in claim 1 wherein having any color or combination of colors and method of colorization, including but not limited to natural material color, died material color, stained, painted, impregnated, and/or infused, respectively.

* * * * *